US012404134B2

(12) United States Patent
Ueda et al.

(10) Patent No.: US 12,404,134 B2
(45) Date of Patent: Sep. 2, 2025

(54) SHEET CONNECTION DEVICE, SHEET CONNECTION METHOD, AND SHEET REPLACEMENT SYSTEM

(71) Applicant: TAKATORI CORPORATION, Nara (JP)

(72) Inventors: Yoshiaki Ueda, Nara (JP); Yuji Ozaki, Nara (JP)

(73) Assignee: TAKATORI CORPORATION, Nara (JP)

( * ) Notice: Subject to any disclaimer, the term of this patent is extended or adjusted under 35 U.S.C. 154(b) by 38 days.

(21) Appl. No.: 18/556,880

(22) PCT Filed: Aug. 4, 2022

(86) PCT No.: PCT/JP2022/029904
§ 371 (c)(1),
(2) Date: Oct. 23, 2023

(87) PCT Pub. No.: WO2023/013723
PCT Pub. Date: Feb. 9, 2023

(65) Prior Publication Data

US 2024/0217768 A1 Jul. 4, 2024

(30) Foreign Application Priority Data

Aug. 6, 2021 (JP) ..... 2021-130341

(51) Int. Cl.
*B65H 19/18* (2006.01)

(52) U.S. Cl.
CPC ... *B65H 19/18* (2013.01); *B65H 2301/46017* (2013.01); *B65H 2301/46171* (2013.01);
(Continued)

(58) Field of Classification Search
CPC ..... B65H 19/18; B65H 21/00; B65H 2301/46017; B65H 2301/46171; B65H 2301/4634; B65H 2404/144
(Continued)

(56) References Cited

U.S. PATENT DOCUMENTS 9,963,826 B2 * 5/2018 Higuchi ..... D21F 1/60

FOREIGN PATENT DOCUMENTS

| | | |
|---|---|---|
| JP | 2002-096952 A | 4/2002 |
| JP | 2014-058149 A | 4/2014 |
| JP | 2018-127323 A | 8/2018 |

OTHER PUBLICATIONS

WIPO, Japanese International Search Authority, International Search Report and Written Opinion (with English translation) mailed Oct. 25, 2022 in International Patent Application No. PCT/JP2022/029904, 8 pages.

* cited by examiner

*Primary Examiner* — James D Sells
(74) *Attorney, Agent, or Firm* — MASUVALLEY & PARTNERS; Peter Martinez

(57) ABSTRACT

The sheet connection device (1) includes: adhesive rollers (10, 10); a joining unit (20) and a cutting unit (30); and feed rollers (40, 40). The cutting unit (30) is capable of forming a connected end portion (SE2) by cutting the second bonding sheet (S2). The adhesive rollers (10, 10) separate the first bonding sheet (S1) into an adhesive sheet (SA) and a release sheet (SP) to form a separated portion (50) by feeding the first bonding sheet (S1) while holding a connecting end portion (SE1) of the first bonding sheet (S1). The feed rollers (40, 40) inserts the connected end portion (SE2) into the separated portion (50) by feeding the second bonding sheet (S2) toward the connecting end portion (SE1). The joining
(Continued)

unit (20) connects the connecting end portion (SE1) and the connected end portion (SE2) to each other by adhesion or welding.

12 Claims, 12 Drawing Sheets

(52) U.S. Cl.
CPC ..... *B65H 2301/4633* (2013.01); *B65H 2301/4634* (2013.01); *B65H 2404/144* (2013.01)

(58) Field of Classification Search
USPC ..... 156/159
See application file for complete search history.

[FIG.1]
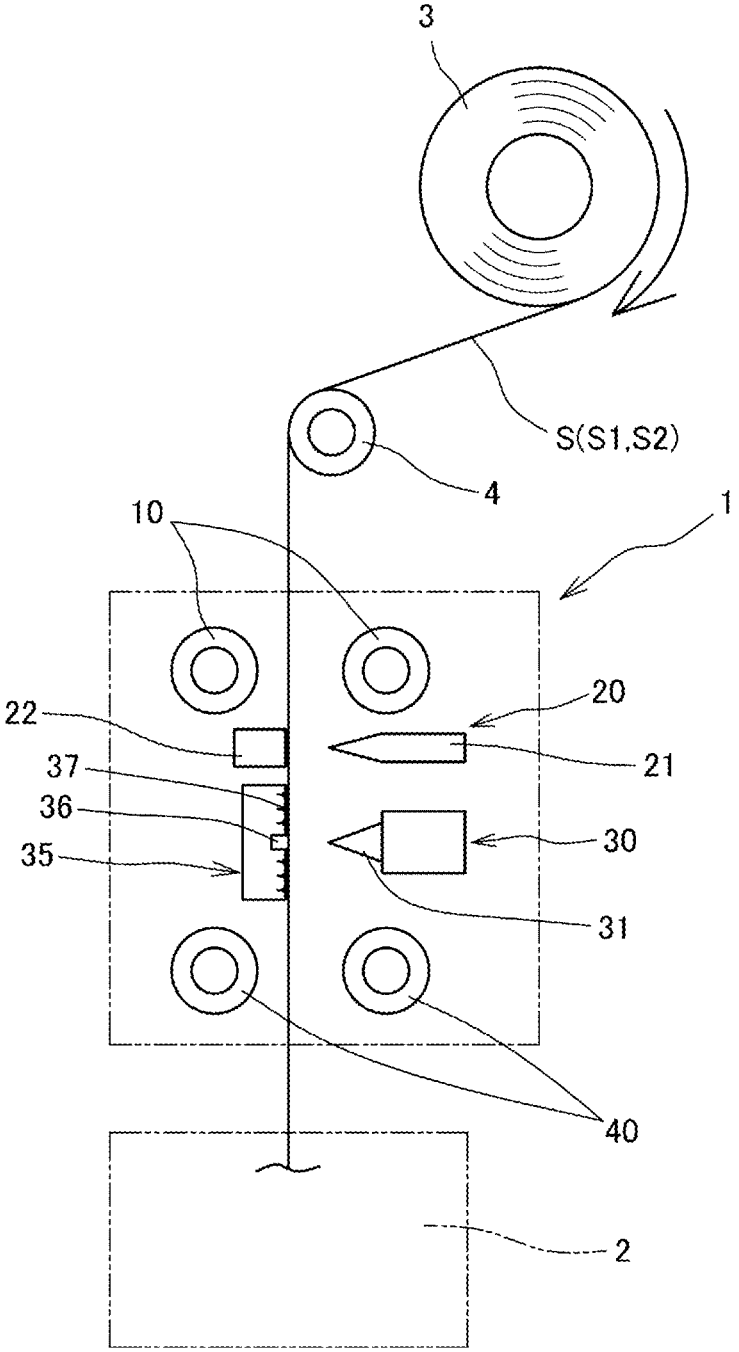

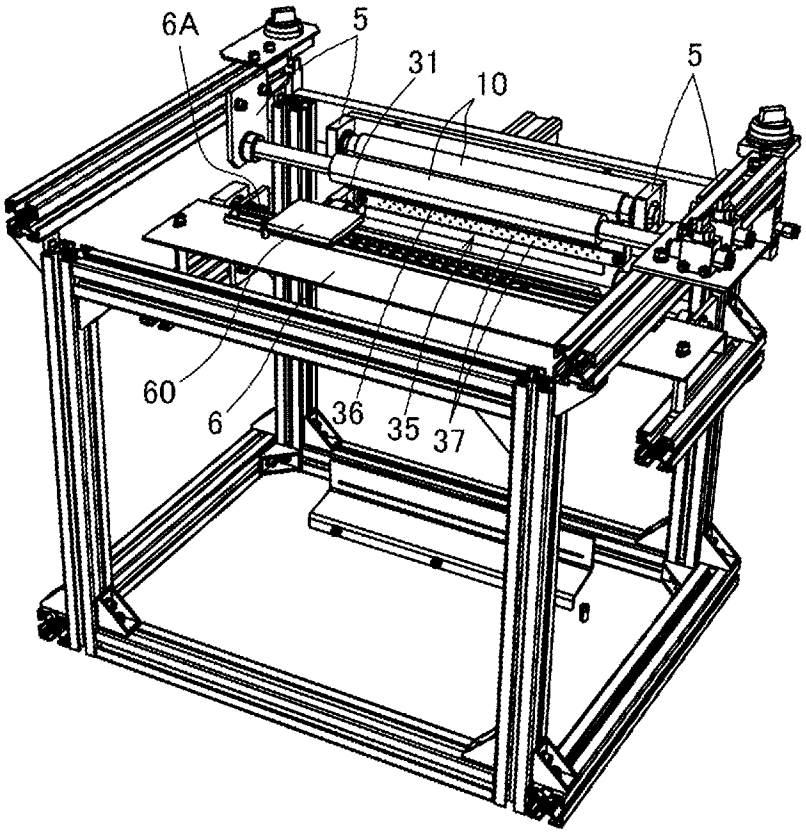
[FIG.2]

[FIG.3]
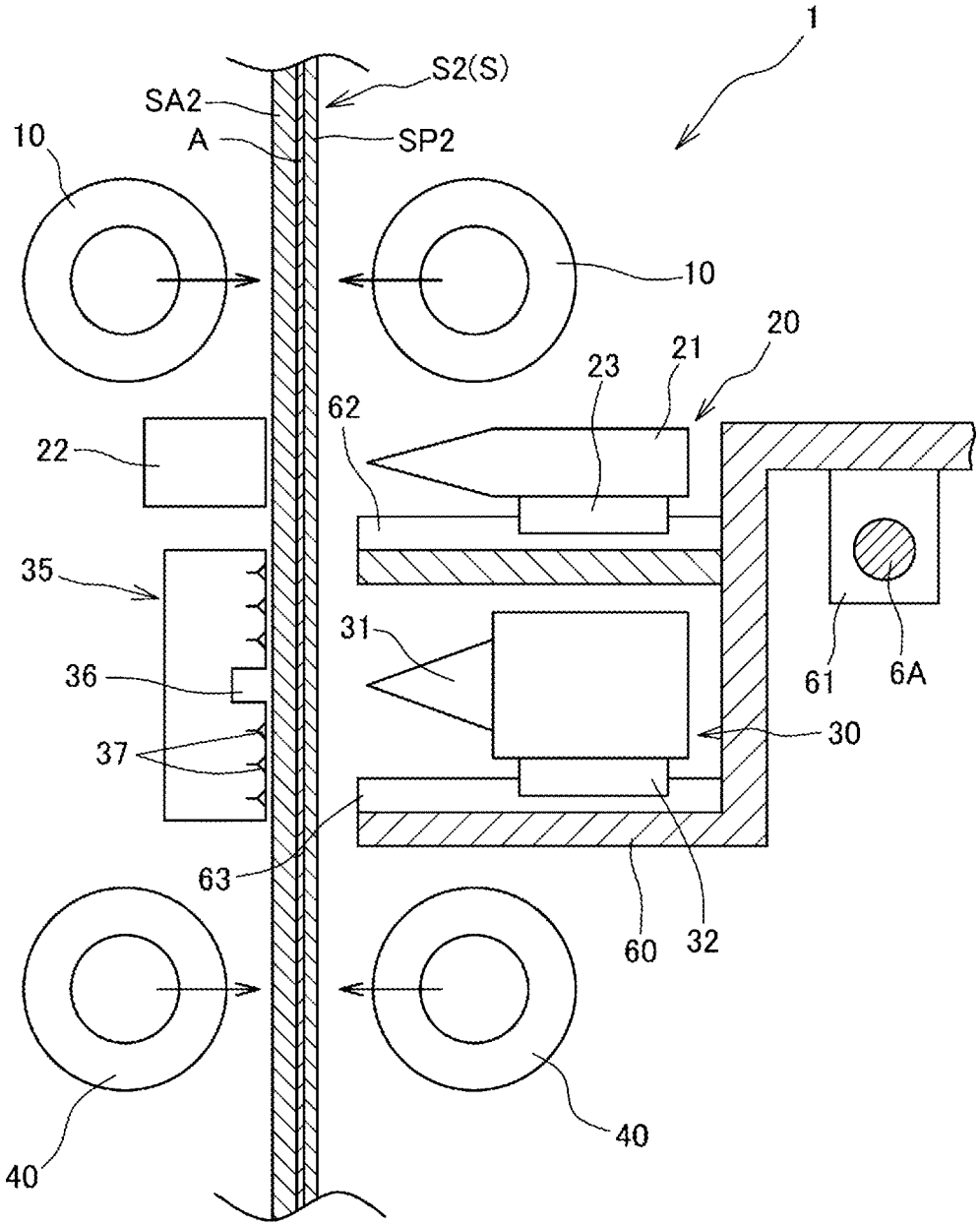

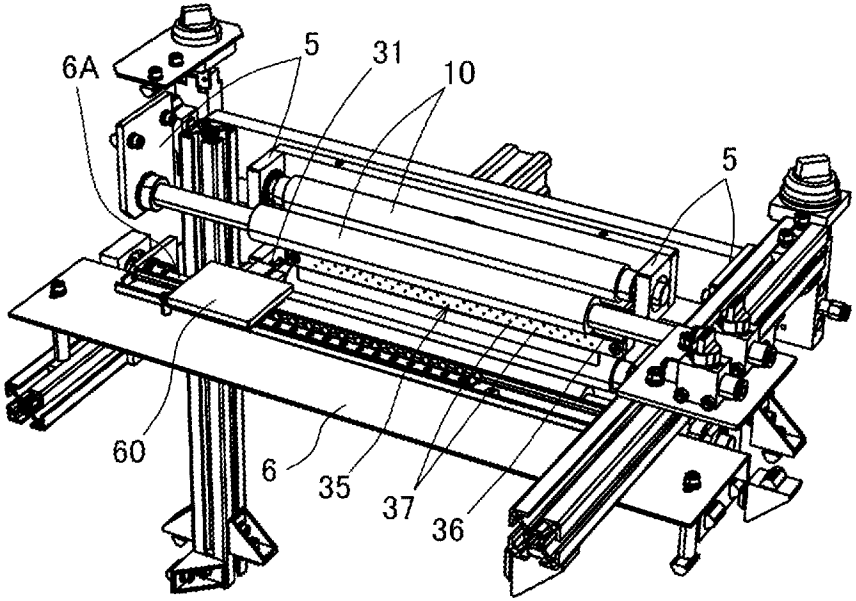
[FIG.4]

[FIG.5]
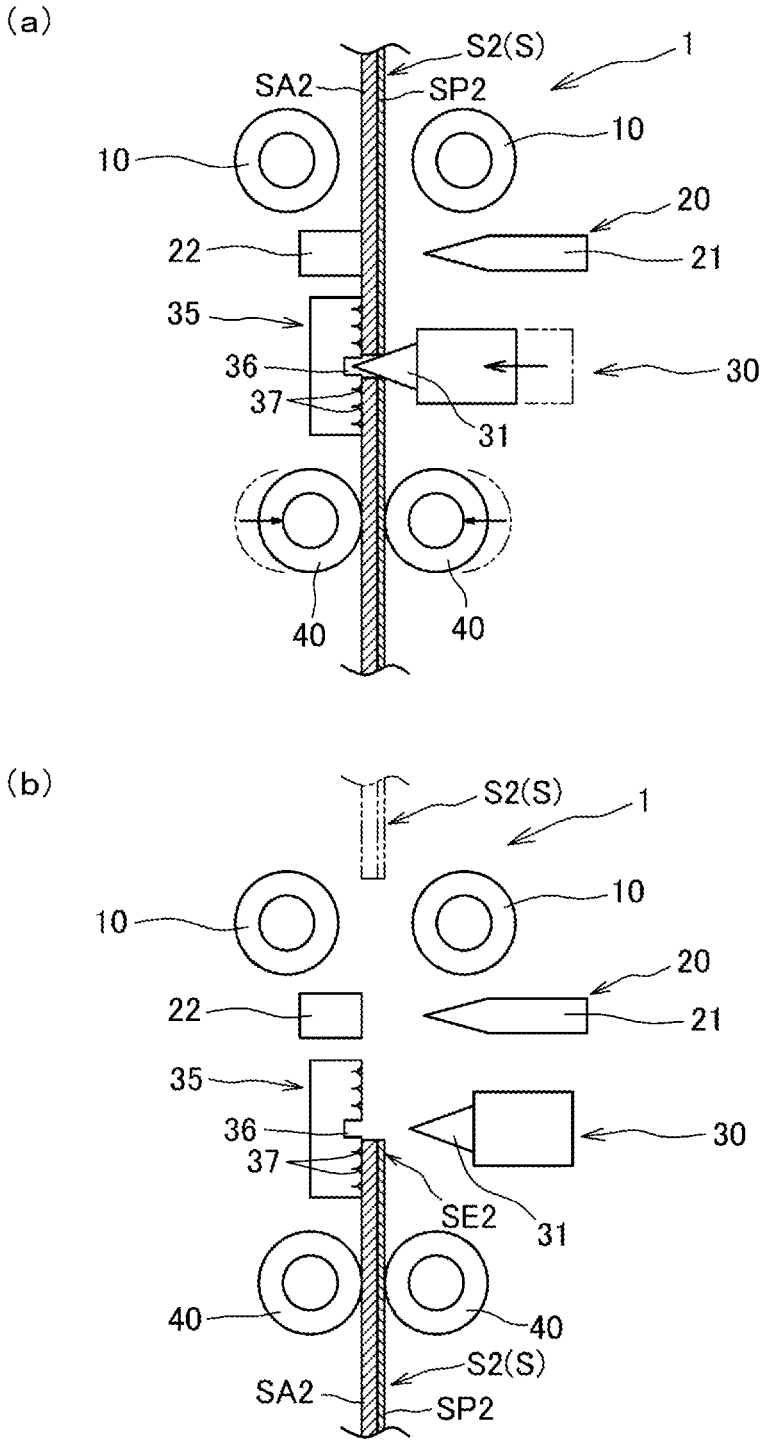

[FIG.6]
(c)
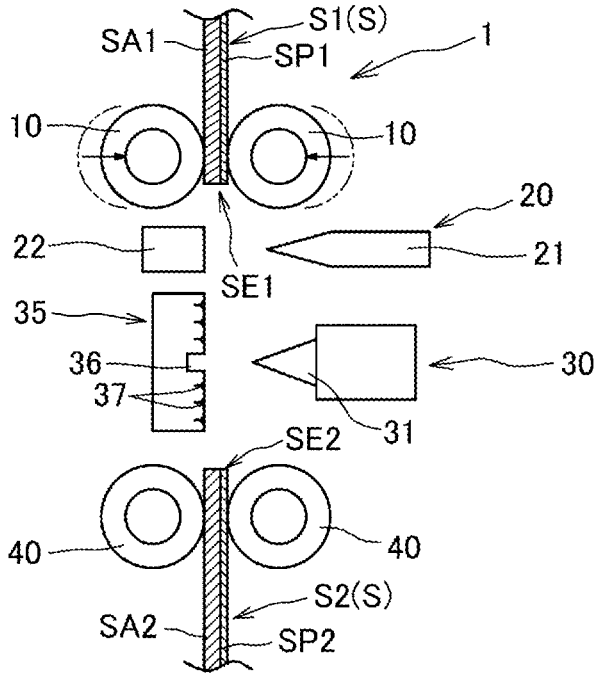
(d)
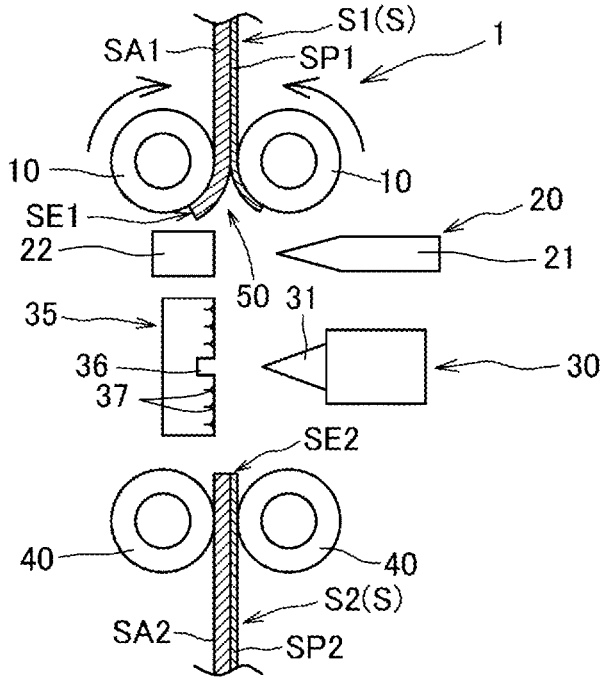

[FIG.7]
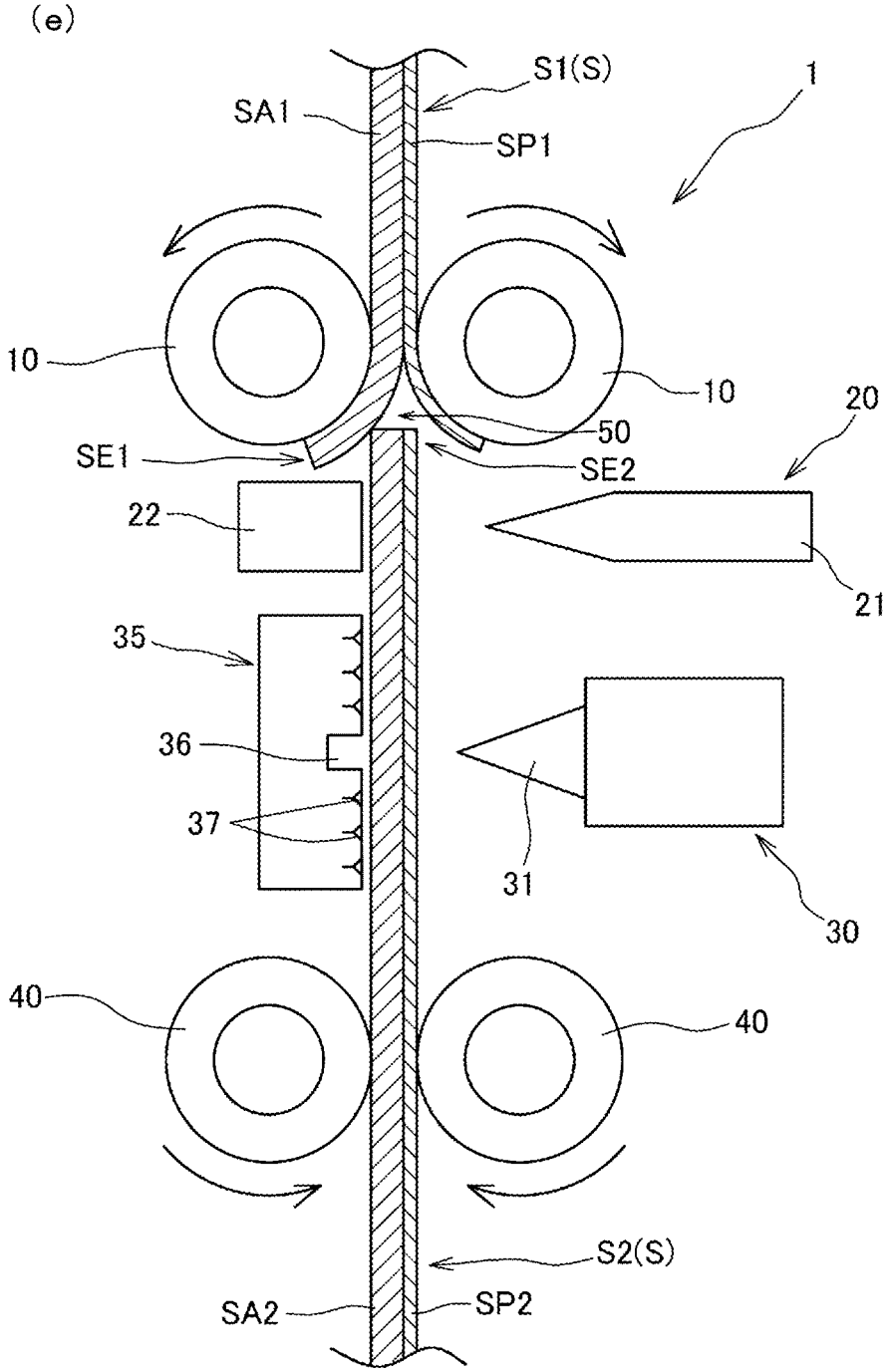

[FIG.8]
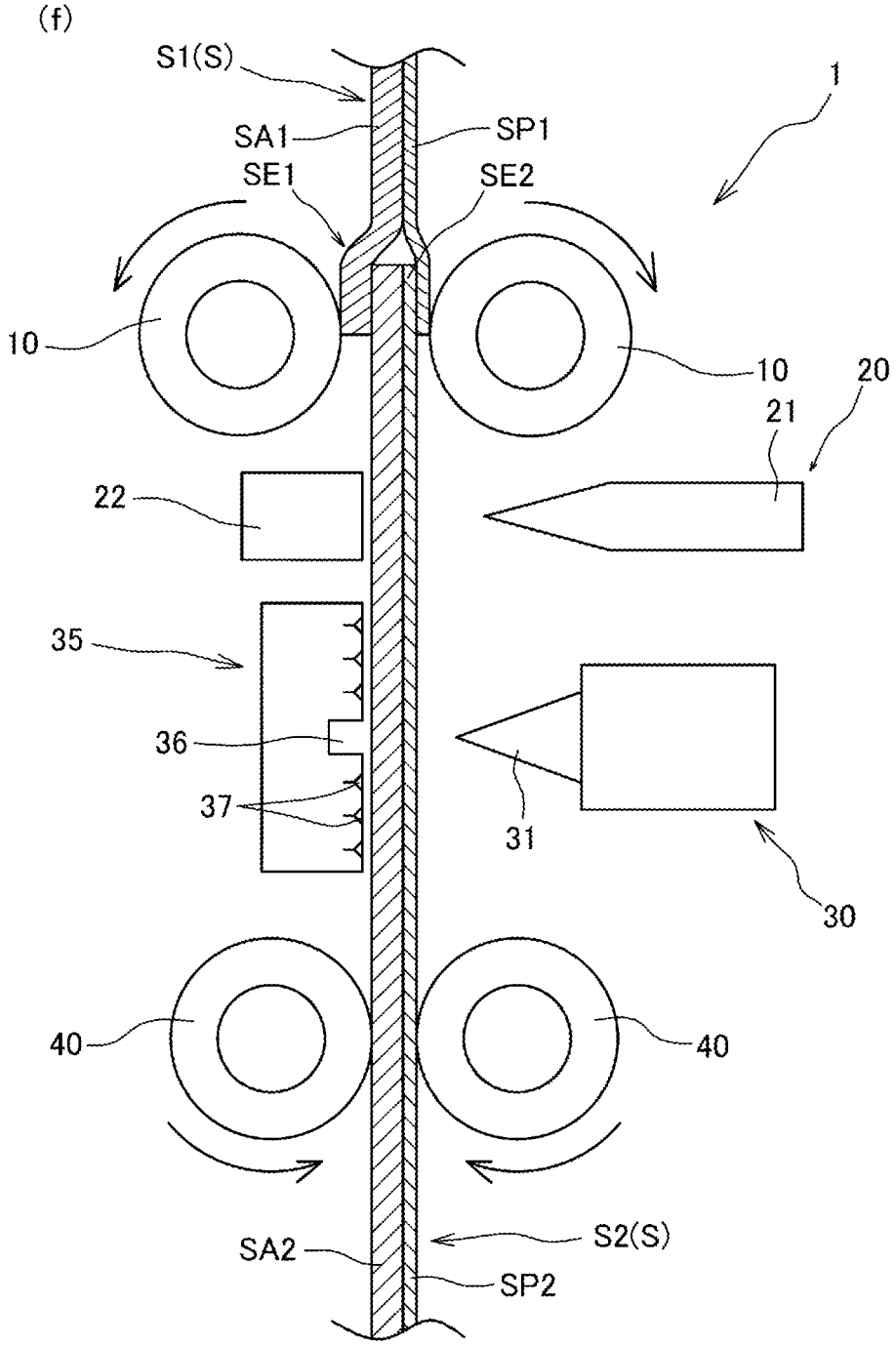

[FIG.9]
(g)
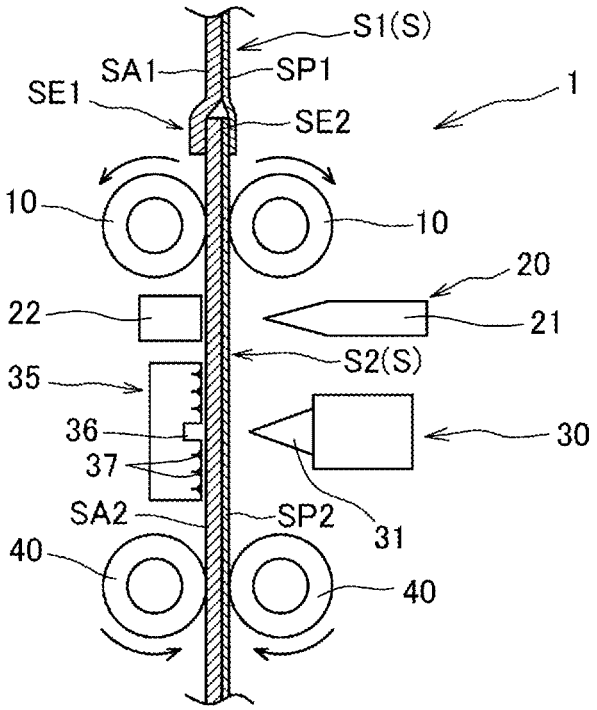
(h)
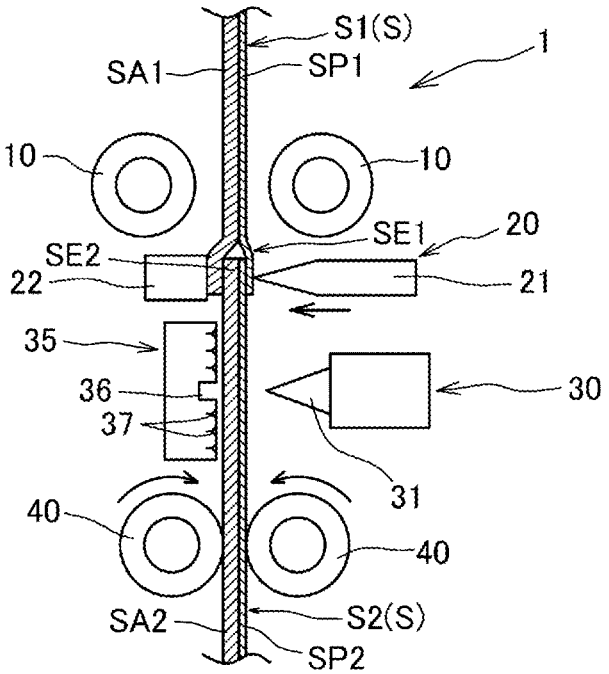

[FIG.10]
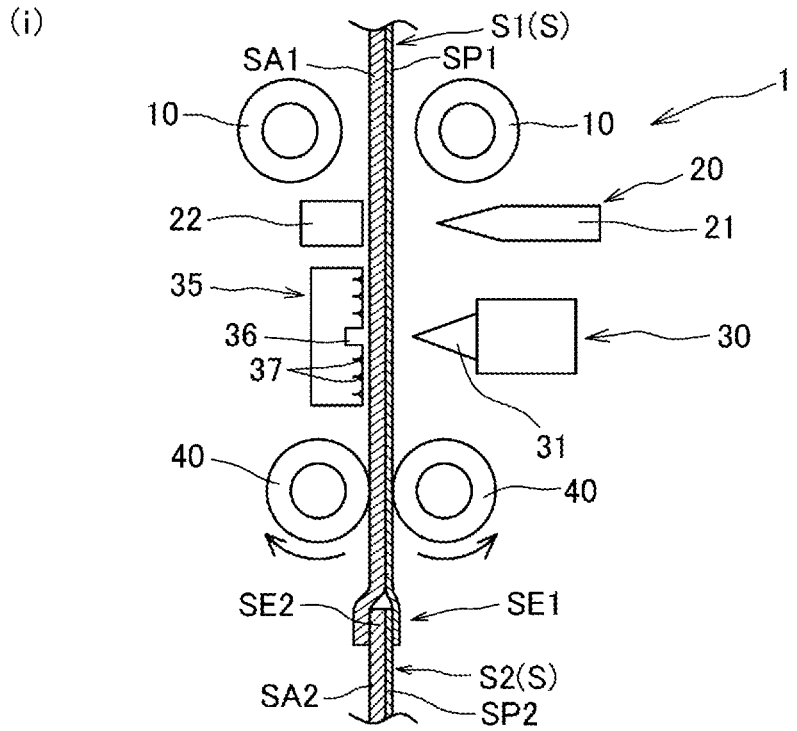

[FIG.11]
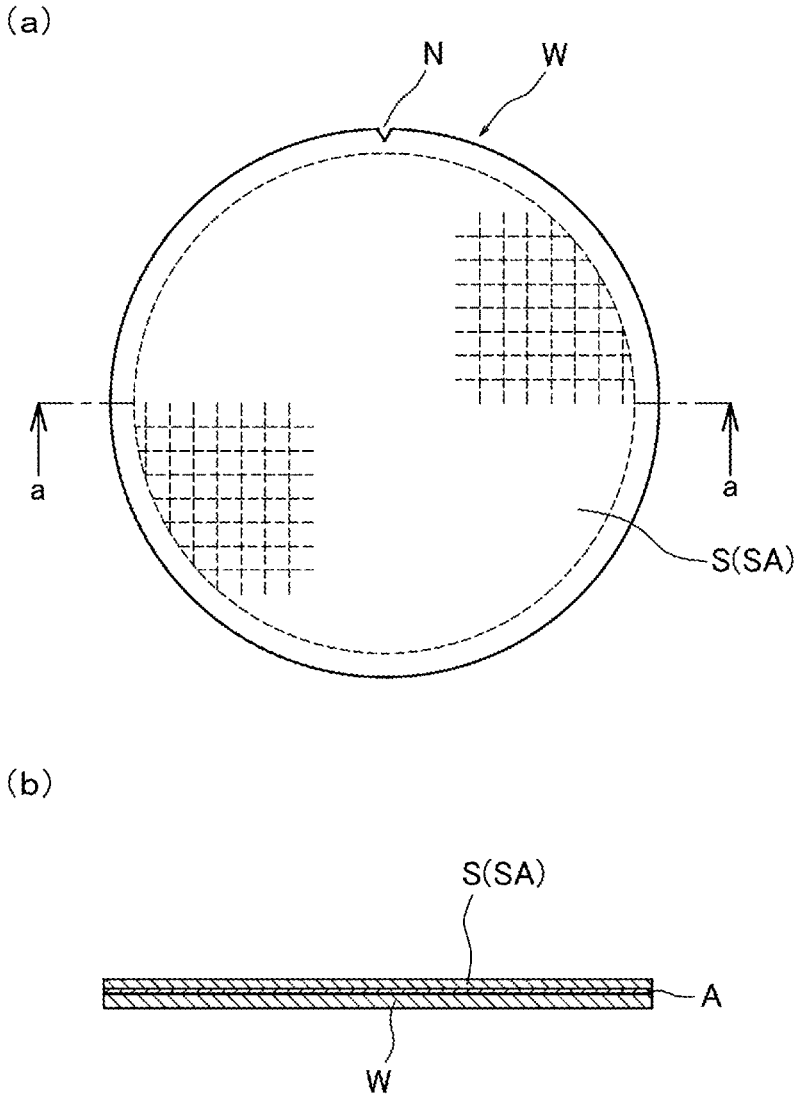

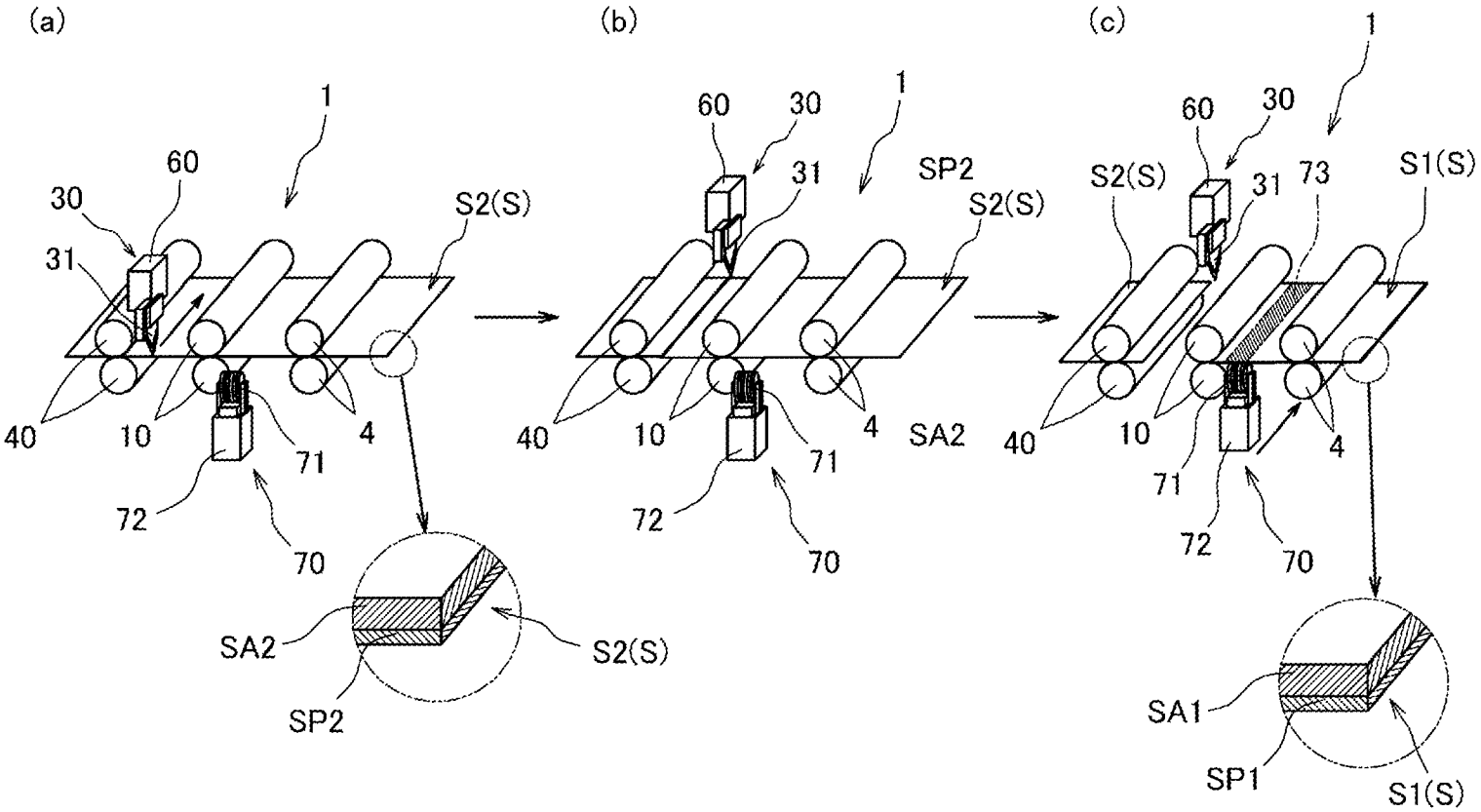
[FIG.12]

SHEET CONNECTION DEVICE, SHEET CONNECTION METHOD, AND SHEET REPLACEMENT SYSTEM

RELATED APPLICATIONS

This application is the U.S. National Phase of and claims priority to International Patent Application No. PCT/JP2022/029904, International Filing Date Aug. 4, 2022, entitled Sheet Connection Device, Sheet Connection Method, And Sheet Replacement System, which claims benefit of and priority to Japanese Application No. 2021-130341 filed Aug. 6, 2021, both of which are incorporated herein by reference in their entireties.

TECHNICAL FIELD

The present invention relates to a sheet connection device, a sheet connection method, and a sheet replacement system. More particularly, the present invention relates to a sheet connection device and a sheet connection method that allow a bonding sheet such as a protecting sheet, which is to be bonded onto a semiconductor wafer, to be connected to another bonding sheet. Further, the present invention also relates to a sheet replacement system for replacing one bonding sheet with another bonding sheet.

BACKGROUND ART

Hitherto, a semiconductor wafer has been reduced in thickness by, for example, forming a circuit pattern on a front surface and thereafter grinding a back surface. Further, for grinding the back surface of the semiconductor wafer, for example, a protecting sheet (also referred to as "back grinding (B/G) tape") is bonded onto the front surface of the semiconductor wafer so as to protect the circuit pattern. Further, for dicing the semiconductor wafer into chips, a dicing tape is bonded onto a dicing frame and the semiconductor wafer. Further, for formation of semiconductor chips, a dry film resist is bonded onto the back surface of the semiconductor wafer in some cases. For the bonding of, for example, the protecting sheet, the dicing tape, and the dry film resist described above, various kinds of sheet bonding devices have been used.

Incidentally, in the sheet bonding device described above, the protecting sheet, the dicing tape, or the dry film resist is supplied in the form of, for example, sheet roll. Thus, after all the sheet is used up, an operator is required to remove a roll of the previous sheet roll and place a new sheet roll. In replacement work for a new sheet roll, it is necessary to pass a new bonding sheet into the sheet bonding device. Thus, there is a problem in that the replacement work requires time. Further, during the replacement work, the production of semiconductor wafers is required to be stopped. Thus, there is a problem in that costs are increased. Further, operation time differs depending on whether the replacement work is performed by a skilled worker or an unskilled worker who is inexperienced in the work. Thus, there is another problem in that replacement work time may differ depending on workers.

For the replacement of, for example, the protecting sheet, the dicing tape, and the dry film resist described above, it is considered that a burden of a sheet passage process into the device in the replacement work can be alleviated by connecting a sheet of a new sheet roll to a trailing edge of the previously used sheet. Thus, an adhesive-tape connection device that connects adhesive tapes to each other has been known as a device for connecting sheets (for example, Patent Literature 1).

CITATION LIST

Patent Literature

[PTL 1] JP 2002-96952 A

SUMMARY OF INVENTION

Technical Problem

However, the adhesive-tape connection device described in Patent Literature 1 uses an adhesive sticking member to connect release paper (corresponding to a release sheet). Thus, there is a problem in that costs are increased due to the use of a supply mechanism for the sticking member and the sticking member being a consumable.

Further, for example, a device that bonds a sheet such as a protecting sheet onto a semiconductor wafer uses a sheet having a width larger than an outer diameter of the semiconductor wafer. Thus, in order to pull out a sheet from a sheet roll, it is considered that a relatively large tensile force is required. Specifically, if sheets are not reliably connected to each other, there may arise a problem in that the connected sheets are disconnected in midway and separated from each other. Recently, in particular, the semiconductor wafer has been increased in diameter (for example, to 300 mm or larger), and hence the above-mentioned problem has become more pronounced.

For the adhesive-tape connection device described in Patent Literature 1, however, a tape width of the sticking member is also required to be increased with an increase in tape width. Thus, there is a problem in that costs for the sticking member may increase. In particular, in order to use the sticking member for a bonding sheet that requires the tensile force described above, the tape width of the sticking member is required to be increased. Thus, there is a problem in that an increase in costs may become pronounced. Further, without reliable connection of the adhesive tapes to each other, the connected sheets may become wavy and thus useless and wasted. In addition, the tensile force may disconnect and separate the connected adhesive tapes from each other.

In view of the problems described above, the present invention has an object to provide a sheet connection device and a sheet connection method that enable reliable connection of a plurality of bonding sheets to each other. Further, the present invention has another object to provide a sheet replacement system that enables replacement of one bonding sheet with another bonding sheet by connecting the one bonding sheet to the another bonding sheet.

Solution to Problem (1) In order to solve the above-mentioned problems, there is provided a sheet connection device for connecting a first bonding sheet arranged on an upstream side in a supply direction and a second bonding sheet arranged on a downstream side in the supply direction with respect to the first bonding sheet to each other in the supply direction, the first bonding sheet and the second bonding sheet each being a bonding sheet including an adhesive sheet and a release sheet formed at least on an adhesive surface of the adhesive sheet in an overlapping manner, the sheet connection device including: a pair of adhesive rollers, which are provided on the upstream side in the supply direction so as to be movable closer to and away from each other with respect to the bonding sheet arranged therebetween, and are capable of holding the bonding sheet therebetween when being moved closer to each other; a joining unit and a cutting unit that are disposed along a supply passage for the bonding sheet; and a pair of feed rollers, which are provided on the downstream side in the supply direction with respect to the joining unit and the cutting unit so as to be movable closer to and away from each other with respect to the bonding sheet arranged therebetween, and are capable of holding the bonding sheet therebetween when being moved closer to each other. The cutting unit is capable of forming a connected end portion by cutting the second bonding sheet in a width direction intersecting with the supply direction. The pair of adhesive rollers each have a surface with adhesiveness and are capable of separating a connecting end portion of the first bonding sheet into the adhesive sheet and the release sheet to form a separated portion by feeding the first bonding sheet from the upstream side toward the downstream side while holding the connecting end portion therebetween. The feed rollers are capable of inserting the connected end portion into the separated portion by feeding the second bonding sheet toward the connecting end portion while holding the second bonding sheet therebetween. The joining unit is configured to connect the connecting end portion and the connected end portion to each other by adhesion or welding under a state in which the connected end portion is inserted into the connecting end portion.

The sheet connection device described above forms the separated portion by separating the connecting end portion of the first bonding sheet into the adhesive sheet and the release sheet with use of the adhesive rollers and inserts the connected end portion of the second bonding sheet into the separated portion. In this manner, an adhesive surface (back surface) of the adhesive sheet of the first bonding sheet is bonded onto a non-adhesive surface (front surface) of the adhesive sheet of the second bonding sheet. Thus, with the sheet connection device described above, adhesive strength allows the first bonding sheet and the second bonding sheet to be temporarily connected to each other. Further, the sheet connection device described above can weld and connect the connecting end portion of the first bonding sheet and the connected end portion of the second bonding sheet to each other through heating under a state in which the second bonding sheet is held onto the first bonding sheet through temporary connection. The sheet connection device described above can reliably connect the connecting end portion and the connected end portion to each other with high precision in the above-mentioned manner. Further, the sheet connection device described above can connect the connected end portion of the second bonding sheet through adhesion using an adhesive. The sheet connection device described above can reliably connect the connecting end portion and the connected end portion to each other with high precision in the above-mentioned manner.

Further, for example, an additional bonding member for connection is not required to be prepared, and a connection margin can be set smaller. Thus, costs can be reduced. Accordingly, the sheet connection device particularly suitable for replacement of the bonding sheet can be provided. Further, the connecting end portion and the connected end portion can reliably be connected to each other through thermal welding. Thus, disconnection between the first bonding sheet and the second bonding sheet that have been connected to each other can be suppressed during the supply of the sheet. Further, waste of the sheet that may become useless due to waving of the sheet that occurs after the connection can be suppressed.

(2) In the sheet connection device of the present invention described above, it is preferred that the joining unit be configured to weld and connect the release sheet in the connecting end portion and the release sheet in the connected end portion to each other through heating.

With the configuration described above, the release sheet in the connecting end portion and the release sheet in the connected end portion can reliably be connected to each other. Thus, the disconnection between the first bonding sheet and the second bonding sheet that have been connected to each other can be suppressed during the supply of the sheet. Further, an additional bonding member for connection is not required to be prepared, and thus an increase in costs can be suppressed.

(3) In the sheet connection device of the present invention described above, it is preferred that the joining unit be configured to cause adhesion and connect the release sheet in the connecting end portion and the release sheet in the connected end portion to each other through application of an adhesive.

With the configuration described above, the release sheet in the connecting end portion and the release sheet in the connected end portion can reliably be connected to each other. Thus, the disconnection between the first bonding sheet and the second bonding sheet that have been connected to each other can be suppressed during the supply of the sheet.

(4) In the sheet connection device of the present invention described above, it is preferred that the pair of adhesive rollers be capable of bringing the connecting end portion, into which the connected end portion has been inserted, into pressure-contact with the connected end portion by feeding the first bonding sheet and the second bonding sheet from the downstream side toward the upstream side in the supply direction.

With the configuration described above, the connecting end portion and the connected end portion can reliably be temporarily connected to each other. Specifically, the adhesive surface of the adhesive sheet in the connecting end portion of the first bonding sheet and the non-adhesive surface of the adhesive sheet in the connected end portion of the second bonding sheet can reliably be temporarily connected to each other. In this manner, even with a small connection margin, the connecting end portion and the connected end portion can be subjected to thermal welding under a state in which the connected end portion is reliably held in the connecting end portion.

(5) In the sheet connection device of the present invention described above, it is preferred that the cutting unit include: a cutter disposed on a side closer to the release sheet; and an attraction body provided on a side closer to the adhesive sheet so as to be opposed to the cutter, and that the attraction body be capable of attracting and holding the second bonding sheet in the width direction and have a cutter groove that is formed at a position opposed to the cutter so as to extend in the width direction.

With the configuration described above, the second bonding sheet can be cut in the width direction under a state in which the second bonding sheet is attracted and held by the attraction body. Thus, the connected end portion at an end of the second bonding sheet can be formed with high precision and connected to the connecting end portion with high precision. Thus, an effect of suppressing the disconnection between the connecting end portion and the connected end portion after the connection can be expected.

(6) In the sheet connection device of the present invention described above, it is preferred that the bonding sheet be a protecting sheet that protects a front surface of a semiconductor wafer, a dicing tape to be used for dicing the semiconductor wafer, or a dry film resist.

With the configuration described above, the sheet connection device suitable for the connection of a protecting sheet (also referred to as "protecting tape" or "back grinding (BG) tape) that protects a front surface of a semiconductor wafer, a dicing tape to be used for dicing of a semiconductor wafer, or a dry film resist can be provided.

(7) In the sheet connection device of the present invention described above, it is preferred that an irregular roller roll on a surface of the first bonding sheet so as to facilitate separation of the first bonding sheet into the adhesive sheet and the release sheet.

With the configuration described above, the adhesive sheet and the release sheet can more reliably be separated from each other.

(8) According to the present invention described above, there is provided a sheet connection method for connecting a first bonding sheet arranged on an upstream side in a supply direction and a second bonding sheet arranged on a downstream side in the supply direction with respect to the first bonding sheet to each other in the supply direction, the first bonding sheet and the second bonding sheet each being a bonding sheet including an adhesive sheet and a release sheet formed at least on an adhesive surface of the adhesive sheet in an overlapping manner, the sheet connection method including: a second bonding sheet cutting step of cutting the second bonding sheet in a width direction into two parts corresponding to a sheet roll-side part and a downstream-side part in the supply direction and forming a connected end portion at one end of the downstream-side part in the supply direction; a first bonding sheet supplying step of supplying the first bonding sheet from an upstream side of the second bonding sheet; a separated-portion forming step of forming a separated portion by feeding a connecting end portion of the first bonding sheet from the upstream side toward the downstream side in the supply direction while the connecting end portion is being held between a pair of adhesive rollers to separate the connecting end portion into the adhesive sheet and the release sheet; a sheet inserting step of inserting the connected end portion into the separated portion by feeding the second bonding sheet from the downstream side toward the upstream side in the supply direction; and a sheet connecting step of causing the pair of adhesive rollers to hold the connecting end portion and the connected end portion therebetween while feeding the first bonding sheet and the second bonding sheet from the downstream side toward the upstream side in the supply direction under a state in which the connected end portion is inserted in the separated portion.

With the sheet connection method described above, the second bonding sheet can be cut into two parts through the second bonding sheet cutting step to form the connected end portion at one end of the downstream-side part in the supply direction. Thus, an operator is not required to directly cut the second bonding sheet, and the connected end portion with high precision can be formed regardless of operator's skills. Further, with the sheet connection method described above, the separated portion can be formed at the connecting end portion of the first bonding sheet through the first bonding sheet supply step and the separated-portion forming step. Thus, the first bonding sheet can be supplied for the subsequent sheet connecting step through easy work of supplying the connecting end portion corresponding to a leading edge of the first bonding sheet between the pair of adhesive rollers.

Further, with the sheet connection method described above, the connected end portion of the second bonding sheet can be inserted into the separated portion formed at the connecting end portion of the first bonding sheet in the sheet inserting step. In this manner, the adhesive surface of the release sheet of the separated portion is bonded onto the non-adhesive surface of the release sheet in the connected end portion of the second bonding sheet. Specifically, the connecting end portion and the connected end portion are temporarily connected to each other. Further, with the sheet connection method described above, the connecting end portion and the connected end portion that have been temporarily connected to each other are held between the pair of adhesive rollers in the sheet connecting step. As a result, the connected end portion is reliably held in the connecting end portion. Further, for example, an additional bonding member for connection is not required to be prepared, and a connection margin can be set smaller. Thus, costs can be reduced. Accordingly, in the manner described above, the sheet connection method particularly suitable for the replacement of the bonding sheet can be provided.

(9) In the sheet connection method of the present invention described above, it is preferred that the sheet connection method further include, after the sheet connecting step, a thermocompression bonding step of thermocompression-bonding the connecting end portion and the connected end portion to each other with use of a joining unit arranged along a supply passage for the bonding sheet under a state in which the connecting end portion and the connected end portion are released from the adhesive rollers.

With the configuration described above, the connecting end portion and the connected end portion can reliably be connected to each other through thermocompression bonding. Thus, the disconnection between the first bonding sheet and the second bonding sheet that have been connected to each other can be suppressed during the supply of the sheet. Further, an additional bonding member for connection is not required to be prepared. Thus, an increase in costs can be suppressed.

(10) In the sheet connection method of the present invention described above, it is preferred that the sheet connection method further include, before the sheet connecting step, an adhesive application step of applying an adhesive with use of an adhesive application unit arranged along a supply passage for the bonding sheet.

With the configuration described above, the connecting end portion and the connected end portion can reliably be connected to each other with use of an adhesive. Thus, the disconnection between the first bonding sheet and the second bonding sheet that have been connected to each other can be suppressed during the supply of the sheet.

(11) According to the present invention described above, there is provided a sheet replacement system using the sheet connection device, the sheet replacement system being configured to replace a bonding sheet to be supplied to a supply destination by connecting an end portion of the first bonding sheet and an end portion of the second bonding sheet to each other.

With the configuration described above, for example, the second bonding sheet, which has been used up, can easily be replaced with the first bonding sheet, which is not used yet. More specifically, the sheet replacement system enables the connection between the end portion (connected end portion)

corresponding to a trailing edge of the second bonding sheet, only a small amount of which remains because of use, and the end portion (connecting end portion) corresponding to a leading edge of the first bonding sheet, which is a new one. As a result, the bonding sheet can be replaced regardless of skills in replacement work. Thus, time required for the replacement of the bonding sheet can be significantly reduced, and costs can be cut.

(12) In the sheet replacement system of the present invention described above, it is preferred that the bonding sheet be a protecting sheet that protects a front surface of a semiconductor wafer, a dicing tape to be used for dicing the semiconductor wafer, or a dry film resist.

With the configuration described above, the sheet replacement system capable of replacing the bonding sheet having a large width such as the protecting sheet that protects the front surface of the semiconductor wafer, the dicing tape to be used for dicing of the semiconductor wafer, or the dry film resist without incurring high costs can be provided. Further, even when a tensile force is required to pull out the protecting sheet, an effect of suppressing the disconnection between the sheets that have been connected to each other after the replacement can be expected.

Advantageous Effects of Invention

According to the present invention, the sheet connection device and the sheet connection method that enable reliable connection of a plurality of bonding sheets to each other can be provided. Further, according to the present invention, the sheet replacement system that enables replacement of one bonding sheet with another bonding sheet by connecting the one bonding sheet to the another bonding sheet can be provided.

BRIEF DESCRIPTION OF DRAWINGS

FIG. 1 is a schematic explanatory view of a protecting-sheet bonding device for which a sheet connection device according to the present invention is used.

FIG. 2 is a partially-omitted outside perspective view for illustrating the sheet connection device according to an embodiment of the present invention.

FIG. 3 is a schematic sectional view for illustrating the sheet connection device according to the embodiment of the present invention, which is taken along a front direction.

FIG. 4 is a partially-omitted enlarged perspective view of a cutting unit of the sheet connection device according to the present invention.

FIG. 5(*a*) and FIG. 5(*b*) are explanatory views for illustrating an operation of the sheet connection device according to the present invention.

FIG. 6(*c*) and FIG. 6(*d*) are explanatory views for illustrating the operation of the sheet connection device according to the present invention.

FIG. 7(*e*) is an explanatory view for illustrating the operation of the sheet connection device according to the present invention.

FIG. 8(*f*) is an explanatory view for illustrating the operation of the sheet connection device according to the present invention.

FIG. 9(*g*) and FIG. 9(*h*) are explanatory views for illustrating the operation of the sheet connection device according to the present invention.

FIG. 10(*i*) is an explanatory view for illustrating the operation of the sheet connection device according to the present invention.

FIG. 11(*a*) is a plan view of a semiconductor wafer on which a protecting sheet is bonded, and FIG. 11(*b*) is a sectional view of the semiconductor wafer, taken along the line a-a.

FIG. 12(*a*) to FIG. 12(*c*) are explanatory views for illustrating an operation for triggering separation performed by the sheet connection device according to the present invention.

DESCRIPTION OF EMBODIMENTS

A sheet connection device 1 according to an embodiment of the present invention is described in detail with reference to FIG. 1 to FIG. 12. It should be noted that thicknesses of a bonding sheet S, a first bonding sheet S1, and a second bonding sheet S2 are exaggerated in the drawings. Further, it should be noted that shapes and sizes of a joining unit 20 and a cutting unit 30 are schematically illustrated in the drawings other than FIG. 2 and FIG. 4 for ease of description.

FIG. 1 is a schematic explanatory view of a protecting-sheet bonding device 2 for which the sheet connection device 1 according to the present invention is used. The protecting-sheet bonding device 2 is a device for bonding a protecting sheet S (also referred to as "bonding sheet S") onto a semiconductor wafer W (also referred to as "wafer W") illustrated in FIG. 11(*a*) and FIG. 11(*b*). The wafer W has a notch N indicating crystal orientation in its outer peripheral portion. A circuit pattern is formed on a front surface of the wafer W. An illustration of details of bonding of the protecting sheet S in the protecting-sheet bonding device 2 is omitted.

As illustrated in FIG. 1, a sheet roll 3 of the protecting sheet S is disposed on an upstream side of the sheet connection device 1. The sheet roll 3 is supported rotatably by a support frame (not shown) (a rotational drive mechanism or a stopper may be appropriately provided). The bonding sheet S fed from the sheet roll 3 is guided by an appropriate guide roller 4 and is supplied to the sheet connection device 1. Further, the protecting-sheet bonding device 2 is disposed on a downstream side of the sheet connection device 1. The protecting sheet S, which has been inserted into the sheet connection device 1, is supplied to the protecting-sheet bonding device 2. In this embodiment, the protecting-sheet bonding device 2 is connected to the sheet connection device 1. However, the sheet connection device 1 may be incorporated into and formed integrally with the protecting-sheet bonding device 2.

FIG. 2 is a partially-omitted outside perspective view of the sheet connection device 1 when viewed from an upper rear side. FIG. 3 is a schematic sectional view of the sheet connection device 1 when viewed in a direction from a front side. Further, FIG. 4 is an enlarged perspective view of a main part of FIG. 2. It should be noted that an illustration of the bonding sheet S and the joining unit 20 is omitted in FIG. 2 and FIG. 4. As illustrated in FIG. 3, the sheet connection device 1 includes, for example, a pair of adhesive rollers 10, 10, the joining unit 20, the cutting unit 30, and a pair of feed rollers 40, 40. The joining unit 20 and the cutting unit 30 are disposed along a supply passage for the bonding sheet S. Further, the sheet connection device 1 includes a drive unit 60 that supports the joining unit 20 and the cutting unit 30.

Further, the bonding sheet S is inserted into the sheet connection device 1. In the following description, one bonding sheet S, which is neither mounted in place nor used yet, is referred to as the first bonding sheet S1, and the bonding sheet S being currently used, which has already been inserted into the sheet connection device 1, is referred to as the second bonding sheet S2. In this embodiment, it is supposed that the first bonding sheet S1, which is a new one, is connected to the second bonding sheet S2. Further, the first bonding sheet S1 is disposed on an upstream side in a supply direction, and the second bonding sheet S2 is disposed on a downstream side with respect to the first bonding sheet S1.

The protecting sheet S corresponding to the bonding sheet S to be used in this embodiment is bonded, for example, so as to protect a circuit-pattern surface of the wafer W when back grinding is performed on the wafer W. The protecting sheet S includes, for example, an adhesive sheet SA and a release sheet SP. The adhesive sheet SA is to be bonded onto the circuit-pattern surface. The release sheet SP is formed on an adhesive layer A of the adhesive sheet SA in an overlapping manner. The adhesive sheet SA includes, for example, a base material such as an ethylene-vinyl acetate copolymer (EVA) or polyethylene terephthalate (PET) and the adhesive layer A laminated on the base material. Before the protecting sheet S is bonded, the release sheet SP is stripped off. An adhesive surface (adhesive layer A) of the adhesive sheet SA is bonded onto the wafer W. The protecting sheet S is bonded onto the circuit-pattern surface of the wafer W in the following manner. Specifically, the protecting sheet S is bonded after being cut into a shape of the wafer W in advance or is cut into a shape of the semiconductor wafer W after being bonded onto the semiconductor wafer W.

As illustrated in FIG. 1 and FIG. 3, the adhesive rollers 10, 10 are disposed on the upstream side in the supply direction in the sheet connection device 1. As illustrated in FIG. 2 and FIG. 4, the adhesive rollers 10, 10 are arranged so as to extend in a width direction of the bonding sheet S, and the adhesive rollers 10, 10 each have a width larger than that of the bonding sheet S. Further, both ends of the adhesive rollers 10, 10 are supported rotatably by support frames 5, 5, respectively.

As illustrated in FIG. 3, the adhesive rollers 10, 10 are provided so as to be movable closer to and away from each other with respect to the bonding sheet S arranged therebetween by an appropriate drive source (not shown) such as a cylinder. The adhesive rollers 10, 10 are only required to be movable closer to and away from each other through their relative movement. Thus, both of the adhesive rollers 10, 10 may be moved closer to and away from each other, or only one of the adhesive rollers 10 may be moved closer to or away from another one of the adhesive rollers 10. In this embodiment, both of the adhesive rollers 10, 10 are provided so as to be movable closer to and away from each other.

When the adhesive rollers 10, 10 are moved closer to each other, the adhesive rollers 10, 10 can hold the bonding sheet S that has been passed between the adhesive rollers 10, 10. When the adhesive rollers 10, 10 are rotated in the supply direction while holding the bonding sheet S therebetween, the bonding sheet S can be supplied and fed from the upstream side toward the downstream side. Further, when the adhesive rollers 10, 10 are rotated in a direction opposite to that described above, the bonding sheet S can be fed reversely from the downstream side toward the upstream side. Further, the adhesive rollers 10, 10 each have a surface made of an adhesive material. Each of the adhesive rollers 10, 10 may be formed by applying an adhesive onto its surface or by winding an adhesive sheet around its surface.

When the adhesive rollers 10, 10 feed the first bonding sheet S1 from the upstream side toward the downstream side while holding a connecting end portion SE1 of the first bonding sheet S1 (bonding sheet S) at its one end (see FIG. 6(*c*)), the connecting end portion SE of the first bonding sheet S1 is separated into an adhesive sheet SA1 and a release sheet SP1 to form a separated portion 50 (see FIG. 6(*d*)). Details thereof are described later in relation to a sheet connection method.

The drive unit 60 supports a heater 21 and a cutter 31, which are described later. A support frame 6 (see FIG. 2 and FIG. 4) is provided behind the drive unit 60 so as to extend horizontally in the width direction of the bonding sheet S. The drive unit 60 is supported by a guide shaft 6A through intermediation of a guide 61. The guide shaft 6A is provided so as to extend in a width direction of the support frame 6. In this manner, the drive unit 60 is permitted to move in the width direction with respect to the bonding sheet S. Further, the drive unit 60 can be moved freely in the width direction by an appropriate drive source (automatically or manually).

A rail 62 is laid on an upper end side (upstream side) of the drive unit 60 so as to face a surface on which the bonding sheet S is formed. Further, a rail 63 is laid on a lower end side (downstream side) of the drive unit 60 so as to be spaced apart from and in parallel to the rail 62.

The joining unit 20 is disposed on a downstream side of the adhesive rollers 10, 10 in the supply direction. The joining unit 20 includes the heater 21 and a backup 22. The heater 21 has a sharp distal end like a soldering iron. The backup 22 is provided so as to be opposed to the heater 21 across the bonding sheet S. The heater 21 can adjust a heating temperature by appropriate current control. Further, the heater 21 is supported by the drive unit 60 and is movably supported on the rail 62 through intermediation of a guide 23. In this manner, the heater 21 is permitted to be moved forward toward and backward from the surface on which the bonding sheet S is formed. The heater 21 is moved forward and backward by an appropriate drive source (not shown). The backup 22 is fixed to an appropriate support frame (not shown) and can support the bonding sheet S on its back side.

The heater 21 can be moved in a direction toward the backup 22 and in the width direction along the guide shaft 6A. In this manner, the connecting end portion SE1 of the first bonding sheet S1 and a connected end portion SE2 of the second bonding sheet S2 can be thermocompression-bonded in the width direction (see FIG. 9(*h*)). Details thereof are described later. At the time of thermocompression bonding, the release sheet SP1 in the connecting end portion SE1 and a release sheet SP2 in the connected end portion SE2 are thermally welded together. The heating temperature of the heater 21 is only required to be set to a temperature at which the release sheets SP can be thermally welded together. The heating temperature of the heater 21 can be appropriately changed in accordance with a composition of the release sheets SP. The heater 21 may be formed so as to be elongated in the width direction so that the bonding sheets S can be integrally pressure-bonded in the width direction. In such a case, the heater 21 is not required to be moved in the width direction.

The cutting unit 30 is disposed on a downstream side of the joining unit 20 in the supply direction. The cutting unit 30 is supported by the drive unit 60. The cutting unit 30 includes the cutter 31 and an attraction body 35. The cutter 31 is disposed on a side closer to the release sheet SP. The attraction body 35 is disposed on a side closer to the adhesive sheet SA so as to be opposed to the cutter 31.

The cutter 31 is movably supported on the rail 63 laid on the drive unit 60 through intermediation of a guide 32. In this manner, the cutter 31 is permitted to be moved forward toward and backward from the surface on which the bonding sheet S is formed. The cutter 31 is moved forward and backward by an appropriate drive source (not shown). Further, the cutter 31 can be moved toward the attraction body 35 and in the width direction along the guide shaft 6A. In this manner, the bonding sheet S can be cut in the width direction that intersects with the supply direction.

The attraction body 35 is provided so as to extend in the width direction of the bonding sheet S (see FIG. 1 and FIG. 4). Further, the attraction body 35 has a cutter groove 36. The cutter groove 36 is formed in a substantial center of the attraction body 35 in an up-and-down direction so as to extend in the width direction. The cutter groove 36 is formed at a position opposed to the cutter 31 and permits insertion of an edge of the cutter 31. In this manner, damage to the edge of the cutter 31 can be suppressed. Further, the bonding sheet S can reliably be cut.

Further, the attraction body 35 has a plurality of attraction holes 37 arranged in the width direction (see FIG. 1 and FIG. 4). The attraction holes 37 are arranged on an upstream side and a downstream side of the cutter groove 36. The attraction holes 37 are connected to an appropriate vacuum pump (not shown) so as to be able to attract and hold the bonding sheet S (second bonding sheet S2) in the width direction. Thus, the bonding sheet S can be cut in the width direction under a state in which the bonding sheet S is attracted and held by the attraction body 35. As a result, the bonding sheet S can be linearly cut with high precision.

The feed rollers 40, 40 are provided on the downstream side in the supply direction with respect to the joining unit 20 and the cutting unit 30. Further, the feed rollers 40, 40 can be moved closer to and away from each other with respect to the bonding sheet S arranged therebetween by an appropriate drive source (not shown). When the feed rollers 40, 40 are moved closer to each other, the bonding sheet S can be held therebetween. Further, when the feed rollers 40, 40 are rotated in the supply direction, the bonding sheet S held therebetween can be fed from the upstream side toward the downstream side. Further, when the feed rollers 40, 40 are rotated in a direction opposite to the supply direction, the bonding sheet S held therebetween can be fed from the downstream side toward the upstream side.

A configuration of the sheet connection device 1 according to the present invention has been described above. Next, the sheet connection method and a sheet replacement system in the sheet connection device 1 are described in detail with reference to FIG. 5 to FIG. 10 and FIG. 12.

As illustrated in FIG. 5(*a*), in an initial state, the second bonding sheet S2 being currently used has been inserted. When an attraction force is exerted through the attraction holes 37 of the attraction body 35 under the above-mentioned state, a non-adhesive surface of the adhesive sheet SA of the second adhesive sheet S2 is attracted and held. Subsequently, the cutter 31 is moved toward the cutter groove 36. At the same time, the drive unit 60 is moved in the width direction. In this manner, the second bonding sheet S2 can be divided into two parts, that is, a sheet roll-side part corresponding to an upstream-side part in the supply direction and a downstream-side part in the supply direction. The connected end portion SE2 is formed at one end on the downstream side in the supply direction (second bonding sheet cutting step). After the second bonding sheet cutting step is completed, the attraction performed through the attraction body 35 is cancelled.

As described above, in the second bonding sheet cutting step, the second bonding sheet S2 can be cut under a state in which the second bonding sheet S2 is attracted and held by the attraction body 35. Thus, the connected end portion SE2 can be formed at an end of the second bonding sheet S2 with high precision and connected to the connecting end portion SE1 with high precision in a sheet connecting step described later. Thus, an effect of suppressing the disconnection between the connecting end portion SE1 and the connected end portion SE2 after the connection can be expected. Further, an operator is not required to directly cut the second bonding sheet S2, and the connected end portion SE2 with high precision can be formed regardless of operator's skills.

Subsequently, as illustrated in FIG. 5(*b*), the cutter 31 is moved backward, and the sheet roll-side part of the second bonding sheet S2 is wound around the sheet roll 3 so as to be collected. The sheet roll 3, which is no longer needed, can be removed and replaced manually or automatically with use of, for example, a robot.

Subsequently, as illustrated in FIG. 6(*c*), the first bonding sheet S1 is supplied from an upstream side of the second bonding sheet S2 (first bonding sheet supply step). The first bonding sheet S1 can be supplied appropriately by replacing the sheet roll 3 and passing the connecting end portion SE1 on one end between the adhesive rollers 10, 10. The replacement of the sheet roll 3 and the passage of the sheet between the adhesive rollers 10, 10 can be performed manually or automatically with use of, for example, a winding and feeding mechanism or a robot. When a plurality of sheet rollers 3 can be stocked in the device, an operation of supplying the bonding sheet S can be continued. In this case, replacement work for the sheet roller 3 is performed later to replace a plurality of sheet rollers 3 at a time. Further, after the first bonding sheet S1 is passed between the adhesive rollers 10, 10, the adhesive rollers 10, 10 are moved closer to each other to hold the connecting end portion SE1 therebetween. At this time, the feed rollers 40, 40 hold the vicinity of the connected end portion SE2 of the second bonding sheet S2. As described above, the first bonding sheet S1 can be supplied for the sheet connecting step described later through easy work of inserting the connecting end portion SE1, which is a leading edge of the first bonding sheet S1, between the pair of adhesive rollers 10, 10.

Subsequently, as illustrated in FIG. 6(*d*), when the adhesive rollers 10, 10 are rotated in the supply direction, the connecting end portion SE1 of the first bonding sheet S1 is fed from the upstream side toward the downstream side in the supply direction while being held between the pair of adhesive rollers 10, 10. In this manner, the connecting end portion SE1 is separated into the adhesive sheet SA and the release sheet SP to thereby form the separated portion 50 (separated-portion formation step). It is preferred that adhesive strength of the adhesive rollers 10, 10 be appropriately changed in accordance with a composition of the bonding sheet S that is to be separated. For the formation of the separated portion 50, an additional mechanism may be provided in addition to the adhesive rollers 10. For example, the separated portion 50 may be formed by a separation trigger mechanism 70 using an irregular roller 71 (porcupine roller 71) (see FIG. 12). The formation of the separated portion 50 by using the separation trigger mechanism 70 is described later in detail in a modification example.

Subsequently, as illustrated in FIG. 7(*e*), when the adhesive rollers 10, 10 and the feed rollers 40, 40 are rotated in directions indicated by arrows illustrated in FIG. 7(*e*), the second bonding sheet S2 is fed from the downstream side toward the upstream side in the supply direction. In this manner, the connected end portion SE2 is inserted into the separated portion 50 (sheet inserting step).

Subsequently, as illustrated in FIG. 8(*f*), when the adhesive rollers 10, 10 and the feed rollers 40, 40 are rotated in directions indicated by arrows illustrated in FIG. 8(*f*), the first bonding sheet S1 and the second bonding sheet S2 are fed from the downstream side toward the upstream side in the supply direction under a state in which the connected end portion SE2 is inserted in the separated portion 50. In this manner, the connecting end portion SE1 and the connected end portion SE2 are held between the pair of adhesive rollers 10, 10 and are brought into pressure-contact with each other to thereby achieve connection therebetween (sheet connecting step). At this time, an adhesive surface (back surface) of the adhesive sheet SA1 in the connecting end portion SE1 is brought into pressure-contact with a non-adhesive surface (front surface) of an adhesive sheet SA2 in the connected end portion SE2, and is bonded and temporarily connected thereto. Thus, the connecting end portion SE1 and the connected end portion SE2 that have been temporarily connected to each other are held between the pair of adhesive rollers 10, 10. As a result, the connected end portion SE2 is reliably held in the connecting end portion SE1. Further, for example, an additional bonding member for connection is not required to be prepared, and a connection margin can be set smaller. Thus, costs can be reduced. Accordingly, the sheet connection device 1 particularly suitable for the replacement of the bonding sheet S can be provided.

Subsequently, as illustrated in FIG. 9(*g*), when the adhesive rollers 10, 10 and the feed rollers 40, 40 are rotated in directions indicated by arrows illustrated in FIG. 9(*g*), the connecting end portion SE1 and the connected end portion SE2 that are connected to each other pass between the adhesive rollers 10, 10 and are fed so as to be positioned on the upstream side of the adhesive rollers 10, 10 in the supply direction.

After that, as illustrated in FIG. 9(*h*), when the feed rollers 40, 40 are rotated under a state in which the connecting end portion SE1 and the connected end portion SE2 are released from the adhesive rollers 10, 10, the connecting end portion SE1 and the connected end portion SE2 that are connected to each other are fed from the upstream side toward the downstream side so as to be opposed to the heater 21. At this time, the connecting end portion SE1 and the connected end portion SE2 are released from the adhesive rollers 10, 10. Thus, the sheets S are not pulled by the adhesive rollers 10, 10. Accordingly, the connecting end portion SE1 and the connected end portion SE2 are disconnected from each other. Subsequently, when the heater 21 is moved toward the backup 22, the connecting end portion SE1 and the connected end portion SE2 are subjected to thermocompression bonding (thermocompression bonding step). As a result, the release sheet SP1 in the connecting end portion SE1 and the release sheet SP2 in the connected end portion SE2 are thermally welded together. Further, the adhesive sheet SA1 in the connecting end portion SE1 is pressure-bonded onto a front surface of the adhesive sheet SA2 in the connected end portion SE2. The bonding between the adhesive sheet SA1 in the connecting end portion SE1 and the adhesive sheet SA2 in the connected end portion SE2 may be achieved through any one or both of thermal welding and adhesion with the adhesive layer A.

With the thermocompression bonding step carried out as described above, the connecting end portion SE1 and the connected end portion SE2 can reliably be connected to each other. Thus, disconnection between the first bonding sheet S1 and the second bonding sheet S2 that are connected to each other can be suppressed during the supply of the sheet. Further, an additional bonding member for connection is not required to be prepared. Thus, an increase in costs can be suppressed. Further, the connecting end portion SE1 and the connected end portion SE2 can be automatically connected to each other with high precision. Thus, waste of the sheet that may become useless due to waving of the sheet that occurs after the connection can be suppressed.

Subsequently, as illustrated in FIG. 10(*i*), when the feed rollers 40, 40 are rotated, the bonding sheet S (the first bonding sheet S1 in this embodiment) held therebetween is fed toward the downstream side in the supply direction. In this manner, the bonding sheet S is supplied to, for example, the protecting-sheet bonding device 2.

As described above, the end portion (connecting end portion SE1) of the first bonding sheet S1 and the end portion (connected end portion SE2) of the second bonding sheet S2 are connected to each other by using the sheet connection device 1 according to the present invention. In this manner, a bonding-sheet replacement system that enables replacement of the bonding sheet S to be supplied to a supply destination can be provided.

With the bonding-sheet replacement system described above, for example, the second bonding sheet S2, which has been used up, can easily be replaced with the first bonding sheet S1, which is not used yet. More specifically, the sheet replacement system enables the connection between the end portion (connected end portion SE2) corresponding to a trailing edge of the second bonding sheet S2, only a small amount of which remains because of use, and the end portion (connecting end portion SE1) corresponding to a leading edge of the first bonding sheet S1, which is a new one. As a result, the bonding sheet S can be replaced regardless of skills in replacement work. Thus, time required for the replacement of the bonding sheet S can be significantly reduced, and costs can be cut. Thus, when the above-mentioned bonding-sheet replacement system is used for the protecting-sheet bonding device 2 for the semiconductor wafer W, production costs of the semiconductor wafer W can be expected to be reduced. Further, with the sheet connection device 1, the sheet connection method, and the bonding-sheet replacement system described above, even when the protecting sheet S (bonding sheet S) has a large width as in a case of a protecting sheet used for the semiconductor wafer W and thus requires a tensile force when the sheet is pulled out, an effect of suppressing the disconnection between the sheets that are connected to each other after the replacement can be expected. Thus, the sheet connection device 1, the sheet connection method, and the sheet replacement system according to the present invention can preferably be used for various kinds of bonding devices for, for example, the protecting sheet S, a dicing tape, and a dry film resist, which are to be bonded onto the semiconductor wafer W. At the separated portion 50 illustrated in FIG. 6(*d*), the connecting end portion SE1 of the first bonding sheet S1 is separated into the adhesive sheet SA1 and the release sheet SP1. When sufficient reproducibility is not obtained only with the adhesive rollers 10, 10, it is preferred that the separation trigger mechanism 70 be added as illustrated in FIG. 12.

A modification example of the sheet connection device 1 in which the separation trigger mechanism 70 is mounted is now described in detail. A description of the same components as those described in the embodiment is omitted. It should be noted that members similar to those in the embodiment described above are denoted by the same reference symbols. Further, it should be noted that illustrations are simplified and some members are omitted in FIG. 12 for ease of understanding.

Modification Example

As illustrated in FIGS. 12, the separation trigger mechanism 70 mounted in the sheet connection device 1 according to a modification example includes, for example, the irregular roller 71 and a support portion 72. The support portion 72 supports the irregular roller 71 rotatably. In the following description, a right side in each of FIG. 12(*a*) to FIG. 12(*c*) corresponds to a sheet roll side (upstream side).

In this modification example, the irregular roller 71 has, for example, a plurality of protrusions (for example, needles) formed on its surface (hereinafter the irregular roller 71 is also referred to as "porcupine roller 71"). The irregular roller 71 is supported rotatably on the support portion 72. When the support portion 72 is driven, the irregular roller 71 can be brought into abutment against a surface of the release sheet SP1 of the first bonding sheet S1.

The support portion 72 supports the irregular roller 71 rotatably. Further, an appropriate drive source (not shown) is connected to the support portion 72, allowing the support portion 72 to be moved in the width direction of the sheet S and in the up-and-down direction.

The separation trigger has the configuration described above. Next, details of formation of a separation trigger in the first bonding sheet S1 with use of the separation trigger mechanism 70 are described.

As illustrated in FIG. 12(*a*) and FIG. 12(*b*), the second bonding sheet S2 being currently used is first cut in the width direction by the cutter 31. A sheet roll-side part (on the right side in FIG. 12(*a*) and FIG. 12(*b*)) of the thus cut second bonding sheet S2 is wound up around the sheet roll 3 and is collected. Although illustration is omitted, after the sheet roll-side part of the second bonding sheet S2 is wound up, the sheet roll 3 is replaced by the sheet roll 3 of the first bonding sheet S1, which is not used yet. Then, the first bonding sheet S1 is supplied from the sheet roll side.

Subsequently, as illustrated in FIG. 12(*c*), on a sheet roll side of the first bonding sheet S1 having a leading edge held between the adhesive rollers 10, 10, the irregular roller 71 is brought into abutment against the release sheet SP1 (lower surface in FIG. 12(*c*)) of the first bonding sheet S1. When the support portion 72 is driven, the irregular roller 71 rolls in the width direction of the first bonding sheet S1 while being in abutment against the release sheet SP1 of the first bonding sheet S1. As a result, air is introduced between the adhesive sheet SA1 and the release sheet SP1, and adhesion between the adhesive sheet SA1 and the release sheet SP1 is weakened. In this manner, a separation trigger region 73 is defined. In this modification example, the separation trigger mechanism 70 uses the porcupine roller 71 to define the separation trigger region 73. However, the separation trigger mechanism 70 is not limited to the configuration described above. The separation trigger mechanism 70 can use various kinds of separation trigger formation means. The irregular roller 71 may roll while being in abutment not against the release sheet SP1 of the first bonding sheet S1 but against a non-adhesive surface of the bonding sheet SA1 depending on conditions. Further, in the modification example illustrated in FIGS. 12, the cutter 31 is arranged on the side closer to the adhesive sheet SA. However, the cutter 31 may be arranged on the side closer to the release sheet SP.

There has been described the embodiment of the sheet connection method and the sheet replacement system that use the sheet connection device 1 according to the present invention. The sheet connection device 1, the sheet connection method, and the sheet replacement system according to the present invention are not limited to those described in the embodiment, and various modifications are possible.

In this embodiment, the joining unit 20 achieves the connection by welding with heating. However, the connection achieved by the joining unit 20 is not limited to that described above. A welding agent may be further used, or the connection may be achieved through adhesion using, for example, a glue or an adhesive. When the adhesive is applied, it is preferred that an adhesive application step of applying an adhesive with use of an adhesive application unit (not shown) that is arranged along the supply passage for the bonding sheet S be carried out before the sheet connecting step. A welding agent or a glue may be used in place of the adhesive depending on a material of the release sheet SP. Further, the adhesive may be applied to any of the connecting end portion SE1 and the connected end portion SE2. It is preferred that a position of the adhesive application unit be determined in accordance with where the adhesive is applied.

In this embodiment, the bonding sheet S including the release sheet SP on one side is used. However, the bonding sheet S is not limited to that described above. Bonding sheets having various kinds of layer structures can be used. Various forms of bonding sheets S, for example, the bonding sheet S including the release sheets SP on both of a front side and a back side and the bonding sheet S including the adhesive layers A formed on both sides of the adhesive sheet SA can be used. Further, not only the bonding sheet S having two layers (the adhesive sheet SA and the release sheet SP) as that used in this embodiment but also the bonding sheet S having a structure including two or more layers may be used. Further, in this embodiment, the protecting sheet S to be used for the semiconductor wafer W has been described as an example of the bonding sheet S. However, not only the protecting sheet S but also various other kinds of bonding sheets S, including, for example, a dicing tape and a dry film resist, can be used. Further, not only the bonding sheet S having a large width but also the bonding sheet S having various widths can be used. Further, in this embodiment, the connection between the second bonding sheet S2 and the first bonding sheet S1 has been exemplified. However, the connection can also be used, for example, when the bonding sheet S is ripped and separated during the supply of the sheet and two separated pieces of paper are connected to each other to obtain the single bonding sheet S again.

In this embodiment, the adhesive roller 10 having a surface made of a material having adhesiveness has been exemplified. However, various forms of adhesive rollers 10, including an adhesive roller made of a material itself having adhesiveness and an adhesive roller with an adhesive sheet wound around its surface, can be used. It is preferred that adhesiveness of the adhesive roller 10 be appropriately changed in accordance with the material of the bonding sheet S. Further, various adhesive rollers can be used as the pair of adhesive rollers 10, 10 in accordance with the material of the bonding sheet S. For example, the adhesive rollers 10, 10 having the same adhesiveness or different adhesiveness can be used. Further, an additional mechanism may be provided in addition to or in place of the adhesive rollers 10 so as to form the separated portion 50.

In this embodiment, the adhesive rollers 10, the joining unit 20, the cutting unit 30, and the feed rollers 40 are arranged in the stated order from the upstream side toward the downstream side in the supply direction. However, the arrangement can be appropriately changed in accordance with a feed direction for the bonding sheet S. Further, in this embodiment, the heater 21 having a sharp distal end like a soldering iron has been exemplified as the joining unit 20. However, various kinds of joining units 20 can be used as long as the connecting end portion SE1 and the connected end portion SE2 are thermally welded together through heating. For example, not only heating means that performs spot-like heating like a soldering iron but also heating means having various shapes and sizes, such as a heater formed so as to extend entirely in the width direction of the bonding sheet S and a heater having irregularity arranged in the width direction, can be used. It is preferred that the heating temperature of the joining unit 20 be appropriately changed in accordance with the material of the bonding sheet S.

Further, in this embodiment, the connecting end portion SE1 and the connected end portion SE2 are thermally welded together entirely in the width direction of the bonding sheet S. However, the thermal welding is not required to be performed entirely in the width direction and may be performed partially. For example, spot-like thermal welding may be performed. In such a case, it is desirable that the connecting end portion SE1 and the connected end portion SE2 be thermally welded together at a plurality of positions set in the width direction of the bonding sheet S.

Further, in this embodiment, the cutting unit 30 includes the cutter 31, and the cutter 31 is moved in the width direction of the bonding sheet S to thereby cut the bonding sheet S. A shape and a size of the cutter 31 may be appropriately changed. For example, the cutter 31 may be formed so as to extend entirely in the width direction the bonding sheet S. In such a case, when the cutter 31 is pressed against the bonding sheet S, the bonding sheet S can be cut.

Further, a size of or a degree of separation in the separated portion 50 to be formed can be appropriately changed in accordance with, for example, a thickness of the bonding sheet S (including thicknesses of the adhesive sheet SA and the release sheet SP) or the material of the bonding sheet S.

In this embodiment, the first bonding sheet S1 and the second bonding sheet S2 are fed from the downstream side toward the upstream side in the supply direction to bring the connecting end portion SE1, into which the connected end portion SE2 has been inserted, into pressure-contact with the connected end portion SE2. However, when the connected end portion SE2 can be held in the connecting end portion SE1, the pressure-contact process may be omitted.

In this embodiment, the cutting unit 30 includes the attraction body 35 that is provided so as to be opposed to the cutter 31. However, a cutter table that does not contribute to attraction may be used in place of the attraction body 35. Further, not only the attraction body 35 using attraction through the attraction holes 37 but also various kinds of means such as means having a surface with light adhesiveness and means having given adhesion strength achieved when, for example, being brought into close contact can be used. Further, in this embodiment, the attraction body 35 has the cutter groove 36. A shape of the cutter groove 36 or whether or not the cutter groove 36 is formed can be appropriately changed in accordance with cutting means to be used.

In this embodiment, in the second bonding sheet cutting step, the second bonding sheet S2 is cut in the width direction to form the connected end portion SE2 at one end on the downstream side in the supply direction. However, when the second bonding sheet S2 is divided into two parts in advance, the second bonding sheet cutting step is preferably omitted. Further, various kinds of means, such as automatic or manual means, can be used in the sheet inserting step as long as the second bonding sheet S2 can be fed into the separated portion 50 from the downstream side toward the upstream side in the supply direction.

The sheet connection device, the sheet connection method, and the sheet replacement system according to the present invention have been described above using an embodiment and a modification example. However, the present invention is not limited to the embodiment or the modification example described above, and it is easily understood for those skilled in the art that other embodiments may be provided from the teaching and spirit of the present invention without departing from the scope of claims.

INDUSTRIAL APPLICABILITY

The sheet connection device, the sheet connection method, and the sheet replacement system according to the present invention can be used for connection of various kinds of bonding sheets including, for example, an adhesive sheet. Further, the sheet connection device, the sheet connection method, and the sheet replacement system according to the present invention can preferably be used for connection of various bonding sheets such as a protecting sheet, a dicing tape, and a dry film resist, which are to be bonded onto a semiconductor wafer.

REFERENCE SIGNS LIST

S bonding sheet (protecting sheet)
A adhesive layer
S1 first bonding sheet
S2 second bonding sheet
SE1 connecting end portion
SE2 connected end portion
SA adhesive sheet
SP release sheet
W semiconductor wafer (wafer)
1 sheet connection device
2 protecting-sheet bonding device
10 adhesive roller
20 joining unit
21 heater
22 backup
30 cutting unit
35 attraction body
36 cutter groove
37 attraction hole
31 cutter
40 feed roller
50 separated portion

The invention claimed is:

1. A sheet connection device for connecting a first bonding sheet arranged on an upstream side in a supply direction and a second bonding sheet arranged on a downstream side in the supply direction with respect to the first bonding sheet to each other in the supply direction, the first bonding sheet and the second bonding sheet each being a bonding sheet including an adhesive sheet and a release sheet formed at least on an adhesive surface of the adhesive sheet in an overlapping manner, the sheet connection device comprising:

a pair of adhesive rollers, which are provided on the upstream side in the supply direction so as to be movable closer to and away from each other with respect to the bonding sheet arranged therebetween, and are capable of holding the bonding sheet therebetween when being moved closer to each other;

a joining unit and a cutting unit that are disposed along a supply passage for the bonding sheet; and a pair of feed rollers, which are provided on the downstream side in the supply direction with respect to the joining unit and the cutting unit so as to be movable closer to and away from each other with respect to the bonding sheet arranged therebetween, and are capable of holding the bonding sheet therebetween when being moved closer to each other, wherein the cutting unit is capable of forming a connected end portion by cutting the second bonding sheet in a width direction intersecting with the supply direction, wherein the pair of adhesive rollers each have a surface with adhesiveness and are capable of separating a connecting end portion of the first bonding sheet into the adhesive sheet and the release sheet to form a separated portion by feeding the first bonding sheet from the upstream side toward the downstream side while holding the connecting end portion therebetween, wherein the feed rollers are capable of inserting the connected end portion into the separated portion by feeding the second bonding sheet toward the connecting end portion while holding the second bonding sheet therebetween, and wherein the joining unit is configured to connect the connecting end portion and the connected end portion to each other by adhesion or welding under a state in which the connected end portion is inserted into the connecting end portion.

2. The sheet connection device according to claim 1, wherein the joining unit is configured to weld and connect the release sheet in the connecting end portion and the release sheet in the connected end portion to each other through heating.

3. The sheet connection device according to claim 1, wherein the joining unit is configured to cause adhesion and connect the release sheet in the connecting end portion and the release sheet in the connected end portion to each other through application of an adhesive.

4. The sheet connection device according to claim 1, wherein the pair of adhesive rollers is capable of bringing the connecting end portion, into which the connected end portion has been inserted, into pressure-contact with the connected end portion by feeding the first bonding sheet and the second bonding sheet from the downstream side toward the upstream side in the supply direction.

5. The sheet connection device according to claim 4, wherein the cutting unit comprises:

a cutter disposed on a side closer to the release sheet; and an attraction body provided on a side closer to the adhesive sheet so as to be opposed to the cutter, wherein the attraction body is capable of attracting and holding the second bonding sheet in the width direction and has a cutter groove that is formed at a position opposed to the cutter so as to extend in the width direction.

6. The sheet connection device according to claim 5, wherein the bonding sheet is a protecting sheet that protects a front surface of a semiconductor wafer, a dicing tape to be used for dicing the semiconductor wafer, or a dry film resist.

7. The sheet connection device according to claim 5, wherein an irregular roller rolls on a surface of the first bonding sheet so as to facilitate separation of the first bonding sheet into the adhesive sheet and the release sheet.

8. A sheet connection method for connecting a first bonding sheet arranged on an upstream side in a supply direction and a second bonding sheet arranged on a downstream side in the supply direction with respect to the first bonding sheet to each other in the supply direction, the first bonding sheet and the second bonding sheet each being a bonding sheet including an adhesive sheet and a release sheet formed at least on an adhesive surface of the adhesive sheet in an overlapping manner, the sheet connection method comprising:

a second bonding sheet cutting step of cutting the second bonding sheet in a width direction into two parts corresponding to a sheet roll-side part and a downstream-side part in the supply direction and forming a connected end portion at one end of the downstream-side part in the supply direction;

a first bonding sheet supplying step of supplying the first bonding sheet from an upstream side of the second bonding sheet;

a separated-portion forming step of forming a separated portion by feeding a connecting end portion of the first bonding sheet from the upstream side toward the downstream side in the supply direction while the connecting end portion is being held between a pair of adhesive rollers to separate the connecting end portion into the adhesive sheet and the release sheet;

a sheet inserting step of inserting the connected end portion into the separated portion by feeding the second bonding sheet from the downstream side toward the upstream side in the supply direction; and a sheet connecting step of causing the pair of adhesive rollers to hold the connecting end portion and the connected end portion therebetween while feeding the first bonding sheet and the second bonding sheet from the downstream side toward the upstream side in the supply direction under a state in which the connected end portion is inserted in the separated portion.

9. The sheet connection method according to claim 8, further comprising, after the sheet t connecting step, a thermocompression bonding step of thermocompression-bonding the connecting end portion and the connected end portion to each other with use of a joining unit arranged along a supply passage for the bonding sheet under a state in which the connecting end portion and the connected end portion are released from the adhesive rollers.

10. The sheet connection method according to claim 8, further comprising, before the sheet connecting step, an adhesive application step of applying an adhesive with use of an adhesive application unit arranged along a supply passage for the bonding sheet.

11. A sheet replacement system using the sheet connection device of claim 1, the sheet replacement system being configured to replace a bonding sheet to be supplied to a supply destination by connecting an end portion of the first bonding sheet and an end portion of the second bonding sheet to each other.

12. The sheet replacement system according to claim 11, wherein the bonding sheet is a protecting sheet that protects a front surface of a semiconductor wafer, a dicing tape to be used for dicing the semiconductor wafer, or a dry film resist.

* * * * *